US005855102A

United States Patent [19]

Chang

[11] Patent Number: 5,855,102

[45] Date of Patent: Jan. 5, 1999

[54] MOLDED BRICK MODULE

[76] Inventor: Houn-I Chang, No. 468, Hsi Tou Rd., Hsi Pan Village, Hsi Chou Hsiang, Chang Hau Hsian, Taiwan

[21] Appl. No.: 25,495

[22] Filed: Feb. 18, 1998

[51] Int. Cl.[6] ..... E04C 1/00

[52] U.S. Cl. ..... 52/604; 52/564; 52/592.6; 52/605; 52/606; 52/607; 52/309.1

[58] Field of Search ..... 52/596, 592.6, 52/604, 605, 606, 607, 608, 609, 309.1, 425, 426, 564

[56] References Cited

U.S. PATENT DOCUMENTS

| | | | |
|---|---|---|---|
| 3,855,752 | 12/1974 | Aylon | 52/605 |
| 5,291,711 | 3/1994 | Kopaz | 52/503 |
| 5,568,710 | 10/1996 | Smith et al. | 52/426 |
| 5,729,943 | 3/1998 | Cambiuzzi | 52/605 X |

FOREIGN PATENT DOCUMENTS

| | | | |
|---|---|---|---|
| 2346514 | 1/1976 | France | 52/606 |
| 84016 | 6/1920 | Sweden | 52/607 |

*Primary Examiner*—Robert Canfield
*Attorney, Agent, or Firm*—Pro-Techtor International Services

[57] ABSTRACT

Disclosed is a molded brick module including two opposite outer surface portions and a middle connecting portion. The surface portion each is integrally formed from two offset strata, such that two pairs of adjacent edges of the outer stratum respectively project beyond and withdraw from two corresponding pairs of adjacent edges of the inner stratum. Engagement of the projected edges on one molded brick module with the corresponding withdrawn edges on the other molded brick module permits two modules to fit together. Cylinders with insertion holes are provided on inner side of two opposite inner strata. The connecting portion has a concavo-concave cross section and includes a central connecting circle and two side connecting semi-circles to form communicable passages in the brick module for mounting conduits, bar reinforcements, etc. and for grouting concrete. Epoxy resin may be applied on the surface portions for paving the modules with tiles.

7 Claims, 8 Drawing Sheets

MOLDED BRICK MODULE

BACKGROUND OF THE INVENTION

The present invention relates to a molded brick module, and more particularly to a brick module integrally molded from plastic material and provided at outer peripheries with connection structure and at inner portion with through holes to serve as conduit passages. With the molded brick module of the present invention, conduit systems can be planned and routed in advance to simplify the wall construction works.

There are two conventional ways for constructing a wall. The first way is by laying bricks. After the brick wall is completed, the wall might need to be locally bored or knocked off to mount conduits and then be repaired with primary cement grout and be screeded. After the primary cement grout has become dried, the wall is finished with fine cement grout or other construction materials, such as tiles, marble slabs, or metal panels. The second way is by grouting concrete. In this way, bar reinforcement and templates must be erected before grouting. After the concrete is set, the templates must be removed and the wall must be finished with fine cement grout or other construction materials, just as in the case of brick wall. The conventional way of constructing a wall by laying bricks includes complicated and time-consuming steps while the water and electric wire conduits can not be easily mounted in the wall. And, the conventional way of constructing a wall by grouting also includes complicate steps and difficult subsequent works to finish fissures and scars caused by templates. Any negligence will cause uneven wall surface. It is therefore tried by the inventor to develop a molded brick module to avoid disadvantages of the conventional ways of constructing walls.

SUMMARY OF THE INVENTION

A primary object of the present invention is to provide a molded brick module which can be easily superposed on another one in a labor and time saving manner while an enhanced construction quality and performance can be achieved.

Another object of the present invention is to provide a molded brick module which can be easily fitted together to conveniently provide passages for conduits and other necessary construction elements in walls to avoid boring or repairing of the walls later.

BRIEF DESCRIPTION OF THE DRAWINGS

The above objects and the technical means adopted by the present invention to achieve the objects can be best understood by referring to the following detailed description of the preferred embodiments and the accompanying drawings, wherein.

DETAILED DESCRIPTION OF THE PREFERRED EMBODIMENTS

Figure 1:
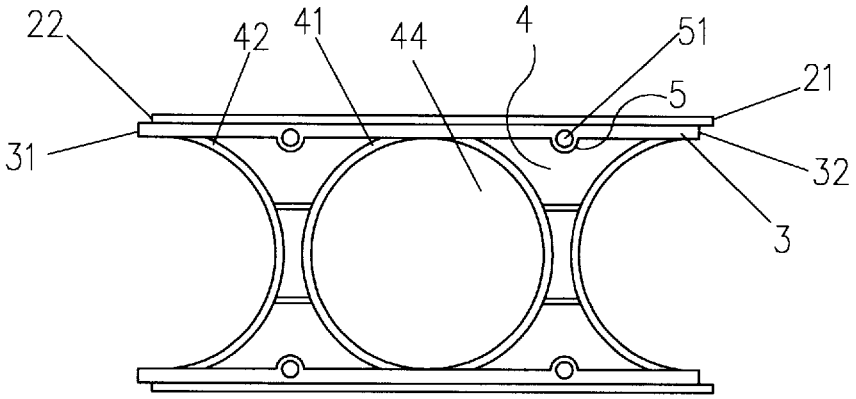
FIG. 1 is a top plan view of a molded brick module according to a preferred embodiment of the present invention.
Figure 2:
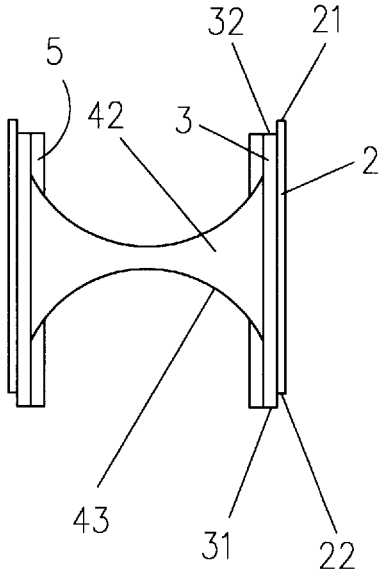
FIG. 2 is a side view of the molded brick module of FIG. 1.
Figure 3:
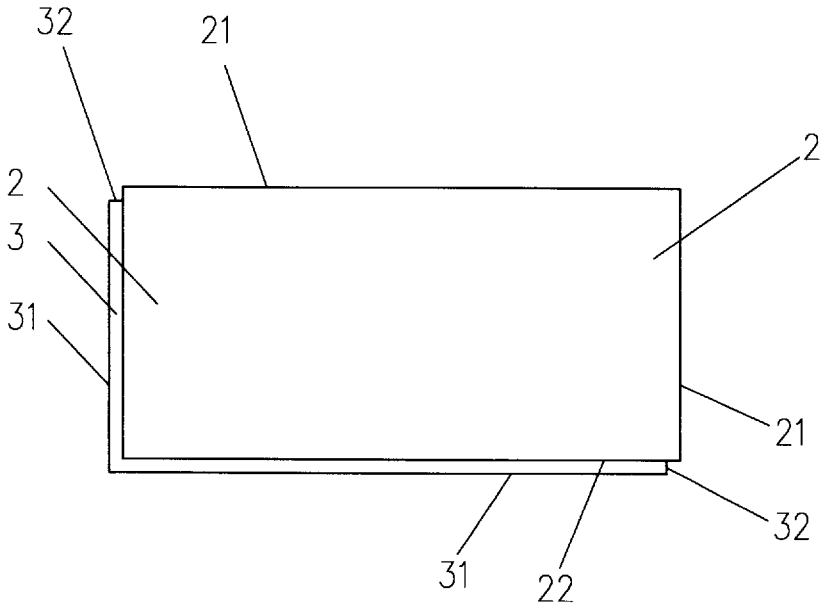
FIG. 3 is a front view of the molded brick module of FIG. 1.
Figure 4:
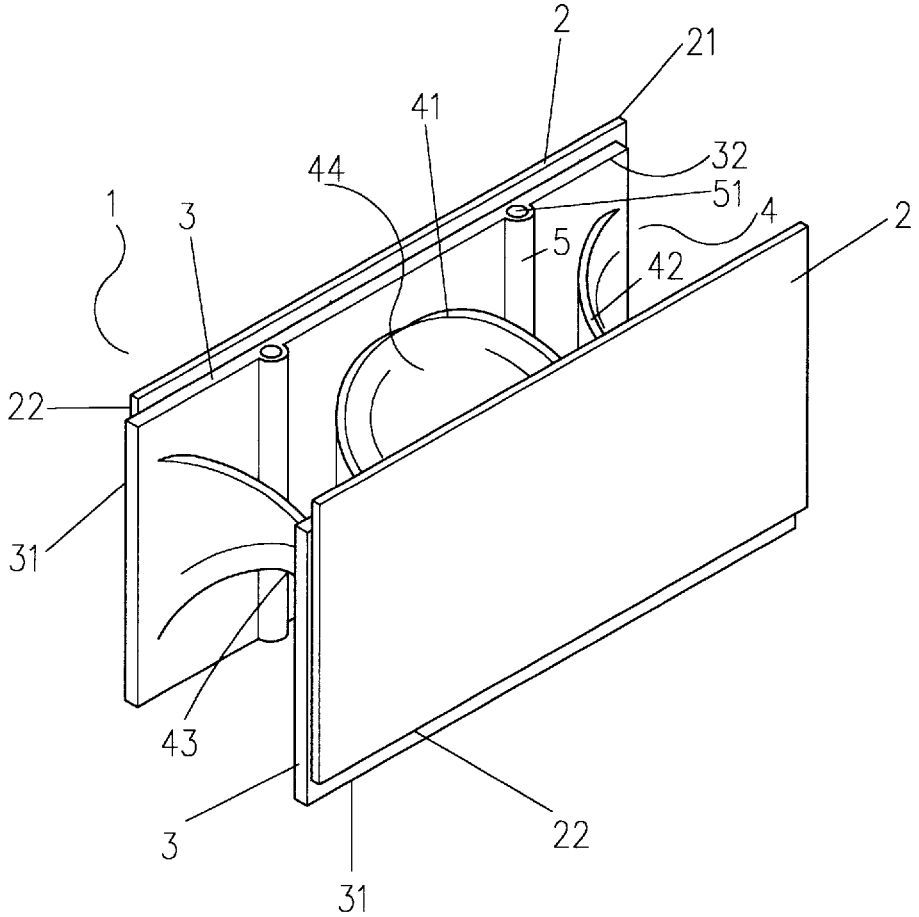
FIG. 4 is a perspective view of the molded brick module of FIG. 1.

Please refer to FIGS. 1 to 4 that sequentially show top plan view, side view, front view, and perspective view of a molded brick module 1 according to a preferred embodiment of the present invention. As shown, the molded brick module 1 is integrally formed from molded plastic material and includes two opposite outer surface portions and a middle connecting portion 4 extending between the two surface portions. The surface portion each is integrally formed from an outer stratum 2 and an inner stratum 3. The outer stratum 2 offsets from the inner stratum 3, such that a first pair of adjacent edges 21 of the outer stratum 2 project beyond a corresponding first pair of adjacent edges 32 of the inner stratum 3, and a second pair of adjacent edges 22 of the outer stratum 2 withdraw from a corresponding second pair of adjacent edges 31 of the inner stratum 3. Whereby, two molded brick modules 1 may be fitted together by engaging the projected edges 21 and 31 on one molded brick modules 1 with the withdrawn edges 22 and 32 on the other molded brick module 1, respectively. Cylinders 5 with insertion holes 51 are preferably symmetrically provided on inner side of two opposite inner strata 3. The connecting portion 4 includes a central connecting circle 41 and two connecting semicircles 42 near two outer ends of the molded brick module 1. The middle connection portion 4 has a concavo-concave cross section, so that both upper and lower edges of the connecting circle 41 and the semicircles 42 are inward curves 43 when viewing from two ends of the brick module 1, as shown in FIG. 2.

Figure 5:
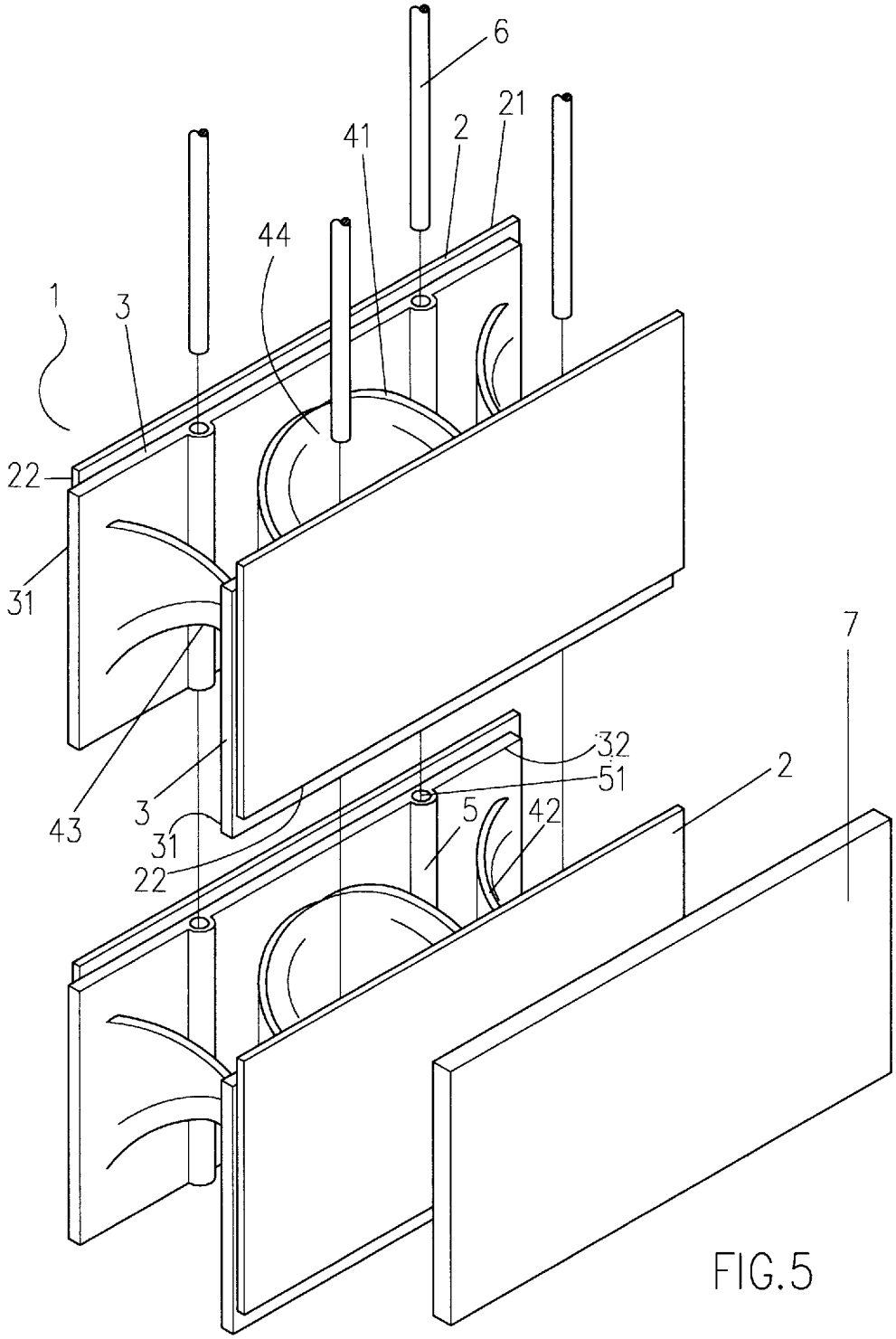
FIG. 5 illustrates the manner in which two molded brick modules of FIG. 1 are bonded together.
Figure 6:
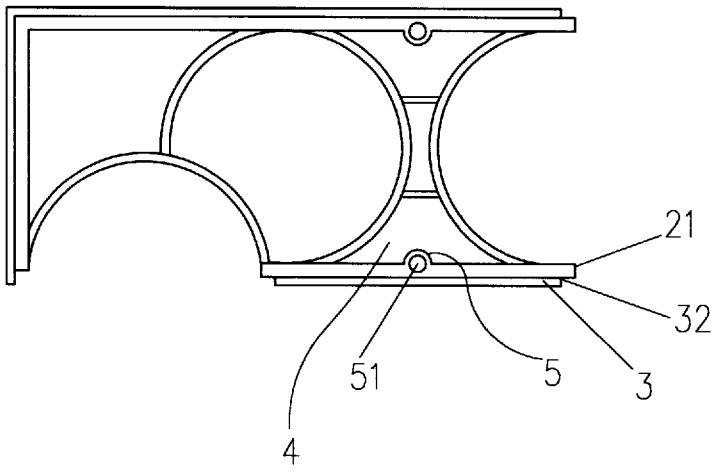
FIGS. 6 to 9 are top plan views showing different embodiments of the molded brick module of the present invention.

Please refer to FIG. 5 that illustrates the manner of bonding two molded brick modules 1 of the present invention together. As shown, two modules 1 may be vertically or horizontally connected to one another by engaging the projected pair of edges 21, 31 of a first module 1 with the withdrawn pair of edges 22, 32 of a second module 1, respectively. Two vertically superposed modules 1 may be in alignment with one another or laterally offset from one another, so long as insertion bars 6 can be extended through insertion holes 51 on two superposed brick modules 1 to further connect the modules 1 together and locate them in place relative to one another. For the molded brick modules 1 that are to be fixedly erected on a ground surface, screws instead of insertion bars 6 may be used to extend through the insertion holes 5 and firmly screw into the ground surface. Thereafter, reinforcing caulking material may be used to caulk joints between the screws and the ground surface. Then, a second and subsequent layers of brick modules 1 may be superposed on the first layer of brick modules 1 in the above described manner as shown in FIG. 5. Epoxy resin may be applied on outer surfaces of the outer strata 2 to pave the brick modules with tiles 7. After the epoxy resin is set and the tiles 7 are fixed in place, another layer of molded brick modules 1 can be superposed on the previously erected brick modules 1 by repeating the same procedures until a whole wall is constructed.

The inward curved upper and lower edges 43 of the connecting circle 41 and the connecting semicircles 42 on two vertically superposed molded brick modules 1 may together define a transverse cylindrical passage. The connecting circle 41 defines a longitudinal cylindrical passage 44. These transverse cylindrical passages and longitudinal cylindrical passages 44 are communicable with one another and allow water and electric wire conduits as well as other necessary construction elements, such as bar reinforcement and switch boxes, to be mounted in the wall when the molded brick modules 1 are superposed. Finally, concrete may be grouted into the internal space of the brick modules 1 to complete a wall.

Figure 7:
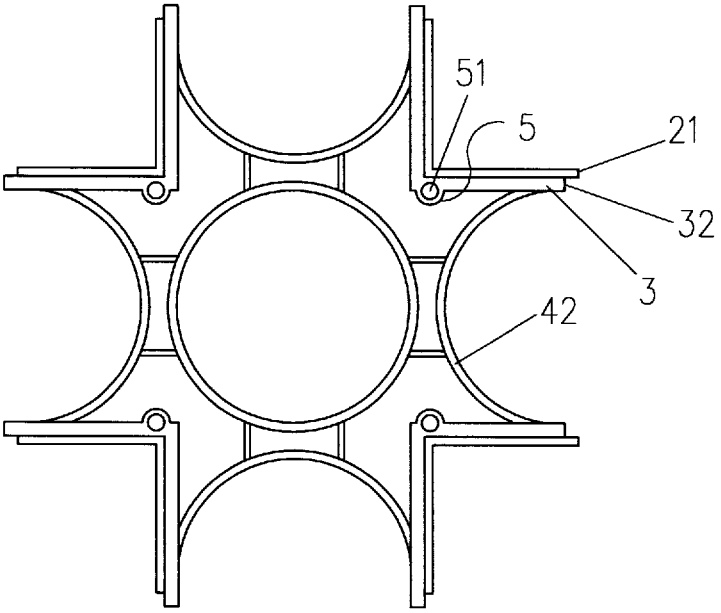
Figure 8:
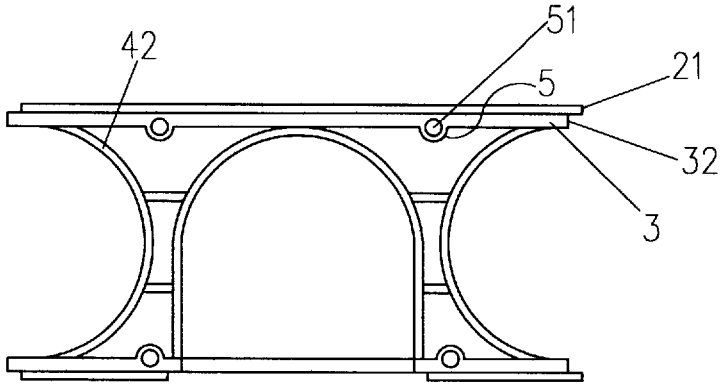
Figure 9:
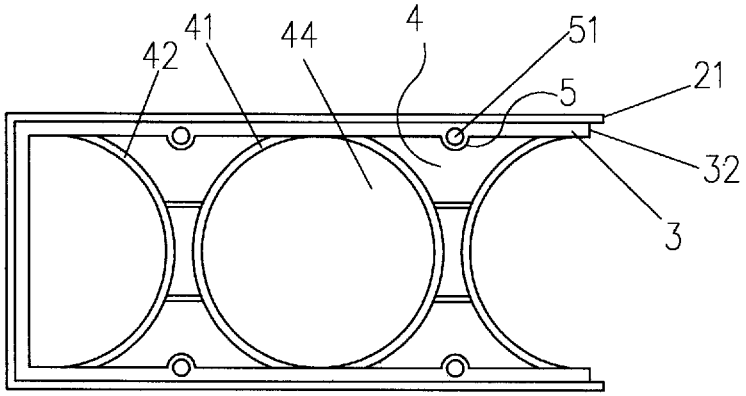

FIGS. 6 to 9 are top plan views showing other embodiments of the present invention. The embodiment shown in FIG. 6 has an opening formed at one lateral end of one of the surface portions and therefore has a generally L-shaped section. In FIG. 7, the molded brick module 1 has a substantially cross-shaped section. In FIG. 8, the molded brick module 1 has a middle opening formed at one of the surface portions and therefore has a generally T-shaped section. One end of the molded brick module 1 shown in FIG. 9 is a closed end surface.

Figure 10:
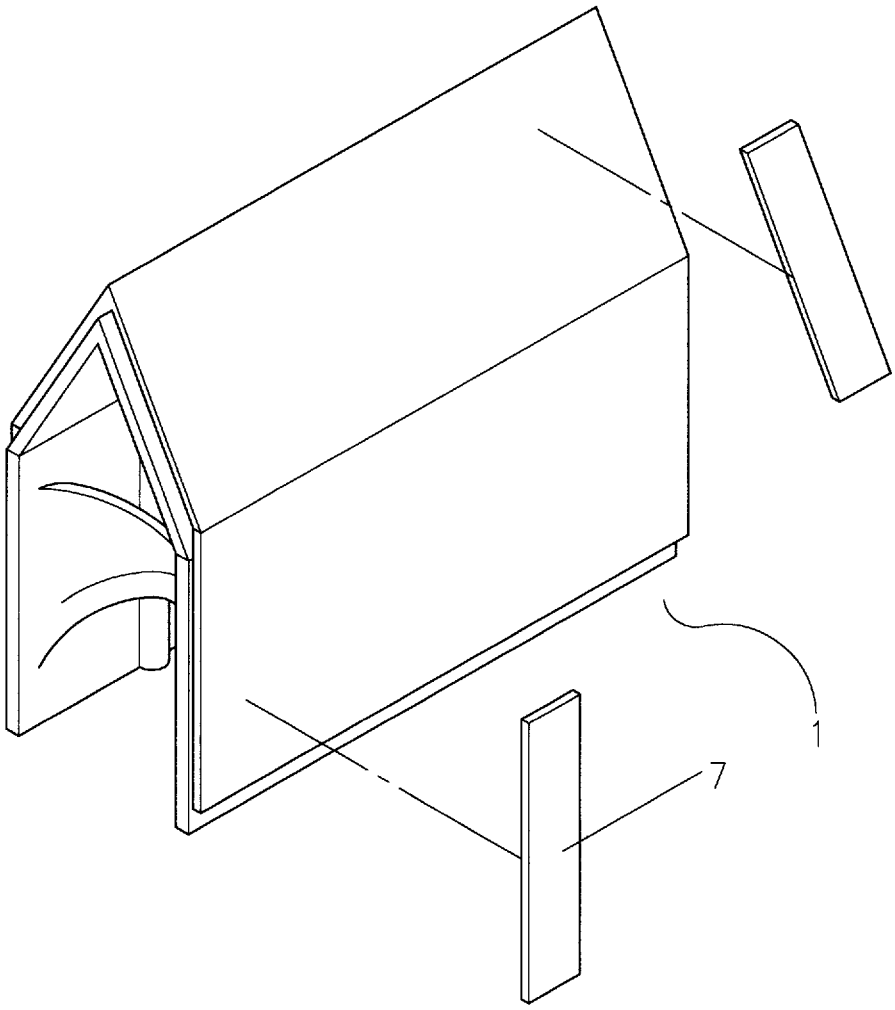
FIG. 10 shows a further embodiment of the molded brick module that has a gable roof.
Figure 11:
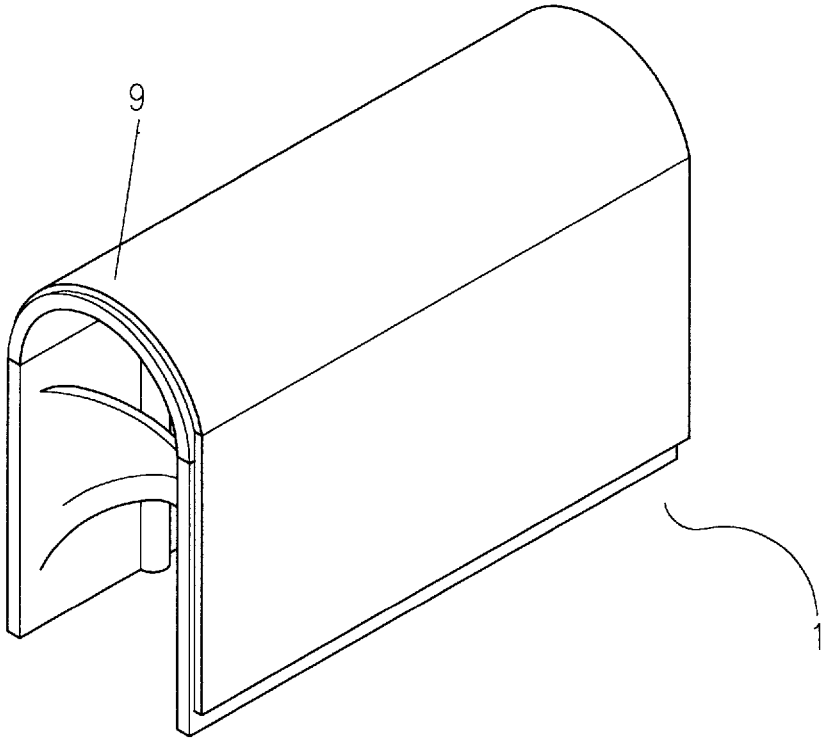
FIG. 11 shows a still further embodiment of the molded brick module that has an arched roof.

FIGS. 10 and 11 are two variant forms of the molded brick module of the present invention. The variant shown in FIG. 10 has a gable roof 8 and the variant shown in FIG. 11 has an arched roof 9, making these molded brick modules define a half-closed space therein.

When the molded brick modules 1 of the present invention is used to construct an exterior wall or interior partition, spacing steel pipes instead of concrete and bar reinforcement may be mounted in the passages 44 provided by the connecting circles 41. The epoxy resin applied on the outer strata 2 of the surface portions permits the molded brick modules 1 to be waterproof and fireproof.

The molded brick modules 1 of the present invention has simple but convenient structure which allows walls to be more easily and quickly constructed from the modules of the present invention than from the conventional bricks or concrete grout and templates. Complicate procedures in conventional wall construction are therefore largely improved.

What is claimed is:

1. A molded brick module integrally formed from molded plastic material, comprising two opposite outer surface portions and a middle connecting portion extending between said two surface portions, said surface portions each being integrally formed from an outer stratum and an inner stratum, said outer stratum offsetting from said inner stratum, such that a first pair of adjacent edges of said outer stratum project beyond a corresponding first pair of adjacent edges of said inner stratum, and a second pair of adjacent edges of said outer stratum withdraw from a corresponding second pair of adjacent edges of said inner stratum, whereby, two molded brick modules may be fitted together by engaging said projected edges on one of said molded brick modules with corresponding withdrawn edges on another said molded brick module; cylinders with insertion holes being symmetrically provided on inner sides of said inner strata; and said connecting portion including a central connecting circle and two connecting semicircles near two outer ends of said molded brick module and having a concavo-concave cross section which makes said connecting circle and said connecting semicircles have inward curved upper and lower edges.

2. A molded brick module as claimed in claim 1, wherein one of said surface portions has an opening formed at one lateral end thereof.

3. A molded brick module as claimed in claim 1, wherein said brick module has a substantially cross-shaped section.

4. A molded brick module as claimed in claim 1, wherein one of said surface portions has an opening formed at a middle area thereof.

5. A molded brick module as claimed in claim 1, wherein said brick module has a straight closed end surface.

6. A molded brick module as claimed in claim 1, wherein said brick module has a gable roof attached thereto.

7. A molded brick module as claimed in claim 1, wherein said brick module has an arched roof.

* * * * *